United States Patent [19]

Gex

[11] Patent Number: 4,972,981

[45] Date of Patent: Nov. 27, 1990

[54] FOLDING CHAIR BACKPACK

[76] Inventor: William T. Gex, 2167 Diamond St., San Diego, Calif. 92109

[21] Appl. No.: 341,880

[22] Filed: Apr. 24, 1989

[51] Int. Cl.[5] ..... A45F 3/14

[52] U.S. Cl. ..... 224/214; 224/250

[58] Field of Search ..... 224/214, 215, 250, 259, 224/209

[56] References Cited

U.S. PATENT DOCUMENTS 4,739,913 4/1988 Moore ..... 224/215

FOREIGN PATENT DOCUMENTS 162448 2/1949 Austria ..... 224/214

5076 3/1909 United Kingdom ..... 224/214

*Primary Examiner*—Renee S. Luebke

[57] ABSTRACT

A backpack for carrying folding chairs has shoulder straps to allow the transport of folding chairs upon the back and shoulders of a person. The chairs are secured in an enveloping structure which size is adjustable to accommodate different sizes and numbers of chairs. This adjustability is accomplished with straps and adjustable fasteners. The bottom of the enveloping structure can be solid allowing long slender objects such as fishing poles or sun umbrellas to be supported and carried along with the folding chairs. A pocket can be attached to the back of the folding chair backpack to enable the transport of other items in addition to the folding chairs.

9 Claims, 5 Drawing Sheets

FOLDING CHAIR BACKPACK

This Patent Application is a substitution of Pat. Application No. 7/151,974 filed Feb. 3, 1988, now abandoned.

BACKGROUND OF THE INVENTION

This invention relates to a folding chair backpack, specifically to a carrier with shoulder straps that allows folded chairs, or other similar flat objects, as well as long slender objects such as fishing poles or sun umbrellas, to be transported like a backpack with the weight being supported by the shoulders and in contact with the back.

Many people prefer to sit in chairs rather than on the ground when sunning at the beach, listening to a concert in the park, talking to others at a picnic, fishing on a lake shore, or doing other outdoor activities that involve sitting. To this end, they will carry their chair(s) from their car to the desired location, often walking many blocks to their destination and frequently negotiating stairs along the way. Also, on hot sunny days, many people will either carry by hand or wish they could carry a sun umbrella to provide shade at the location they desire to sit.

Prior methods for carrying folding chairs to a beach, an open air concert, a picnic, a lake shore, or elsewhere, has been by hand. This can be awkward, especially when the chair drags along the ground while the arm supporting the chair is fully extended, or when trying to carry two or more chairs with one hand. A chair can be carried under the arm only if the arm is long enough and when multiple chairs are carried in this fashion, they must be balanced or the chairs can lean in different directions, forward and aft, and fall out from under the arm. Carrying additional objects, such as snorkels and fins, picnic supplies, fishing poles, or sun umbrellas adds to the difficulty and awkwardness. Besides being awkward, carrying a chair or multiple chairs, fishing poles, and/or sun umbrellas requires the use of at least one hand, maybe both. The use of the hand or hands could be used for other purposes such as carrying other objects like a cooler, holding someone's hand like an infant's or holding onto a handrail for balance and safety.

Many designs for backpacks exist but none can accommodate generic folding chairs and slender objects like fishing poles or sun umbrellas. The Backpack Chair disclosed in U.S. Pat. No. 4,487,345 is a single folding chair that is an integral part of the backpack frame. This does not allow for the transport of existing generic foldable lawn or beach chairs. The military coat carrier disclosed in British Pat. No. 5076 could not accommodate long slender objects for they would slip through the bottom from lack of support. Lateral stability of the load depends on friction with the vertical straps because of the lack of any attachment of the horizontal strap with the vertical straps in the back. This lateral stability can be crucial when hoisting the load from the ground onto one's back. Also shoulder attachments would be required of a person trying to carry the apparatus.

The rucksack disclosed in German Pat. No. 162448 suffers from the same lack of lateral instability due to the absence of any attachments of the horizontal straps with the vertical straps in the back.

The game carrier disclosed in German Pat. No. 276083 has no horizontal adjustable means.

Therefore, most people who carry folding chairs and fishing poles or sun umbrellas for more than a very short distance would find it desirable to have a means of transporting these chairs easily and not require the use of their hands while transporting them.

OBJECTS AND ADVANTAGES OF THE INVENTION

It is an object of the invention to provide a means to carry a folding chair upon the shoulders in a manner similar to a backpack.

Another object of the invention is to provide a means of adjustment to allow for carrying multiple folding chairs and to allow for carrying of different sizes of folding chairs or folding lounge chairs.

Another object of the preferred embodiment of the invention is to provide a means to carry long slender objects such as fishing poles and sun umbrellas with the folding chairs.

Another object of the invention is to provide an enveloping structure such that when folded chairs are secured within this enveloping structure, a secure structural frame is formed that allows additional weight to be supported. It is then possible to attach a pocket or pouch to this enveloping structure and carry additional objects within this pocket or pouch.

Another object of the invention is to provide a means of carrying folded chairs while allowing the hands to be free for other tasks such as carrying objects, holding hands or leashes, grasping handrails for balance and safety, or steering a vehicle such as a bicycle.

Still another object of the invention is to provide a ground cover when the chairs are not secured by the enveloping structure.

Other objects and advantages may be discovered from consideration of the ensuing description and accompanying drawings.

DRAWING REFERENCE NUMERALS

Figure 1:
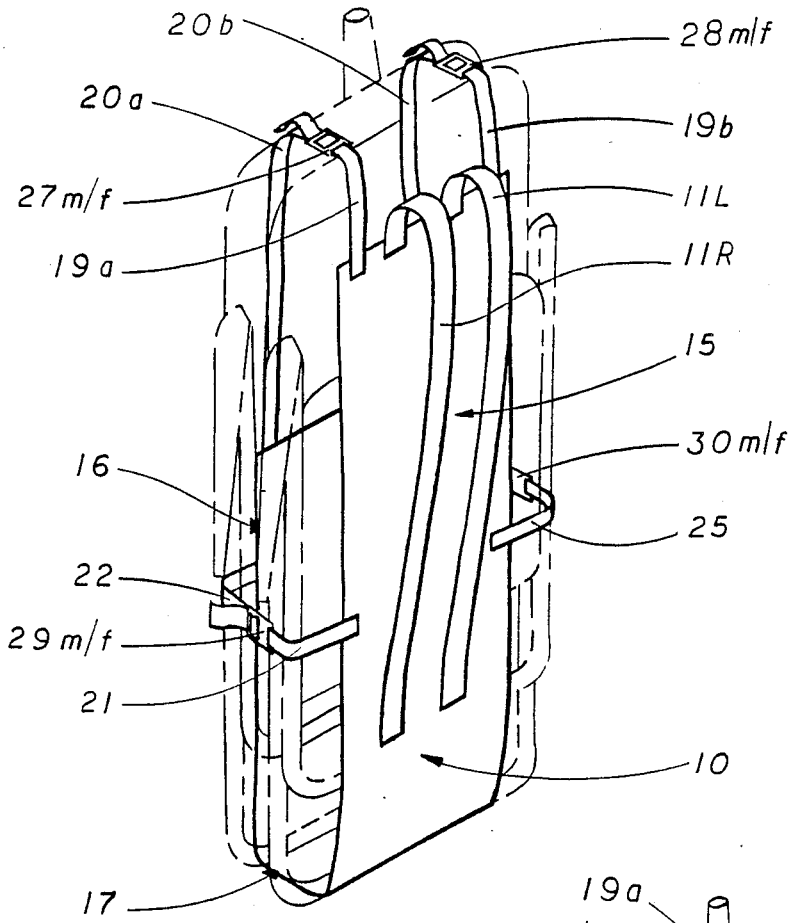
FIG. 1 is a front perspective view of the preferred embodiment of a folding chair backpack enveloping two folded chairs and a sun umbrella.

10 main body
11R,L shoulder straps
12 pocket
13 drawstring
15 front side
16 back side
17 bottom side
19*a,b* top-front straps

20*a,b* top-back straps
21 right side-front strap
22 right side-back strap
25 left side-front strap
26 left side-back strap
27*m,f* top-right adjustable buckle
28*m,f* top-left adjustable buckle
29*m,f* right side adjustable buckle
30*m,f* left side adjustable ,buckle
31*m,f* top adjustable buckle

DESCRIPTION OF THE PREFERRED EMBODIMENT

Figure 2:
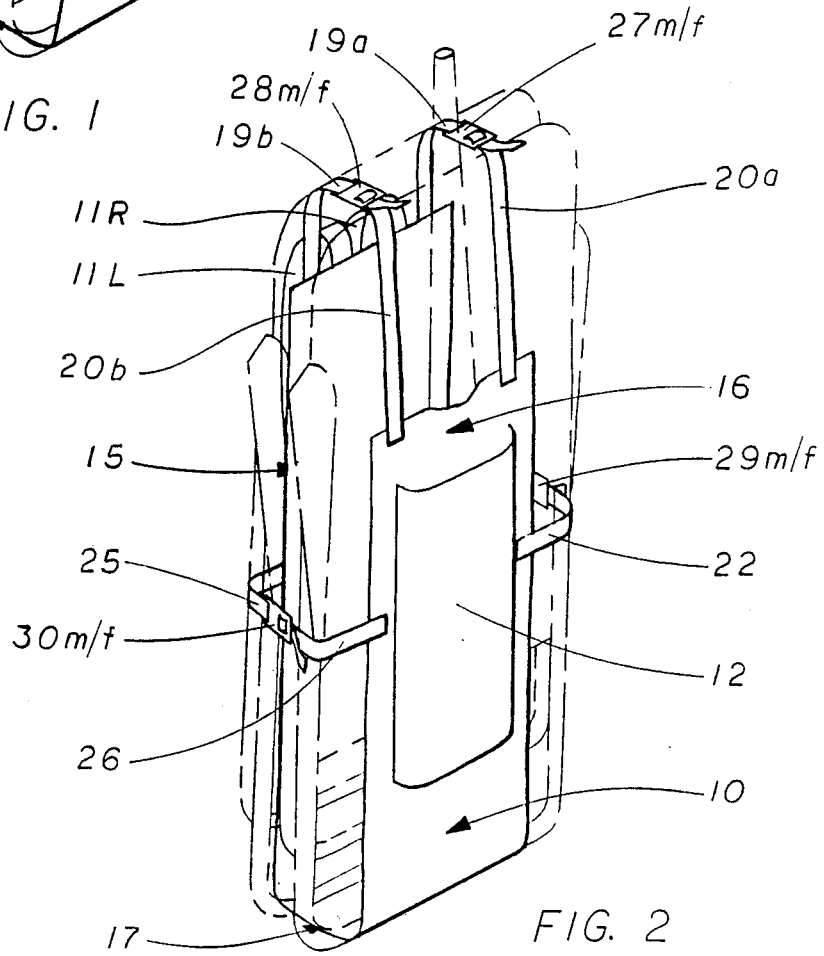
FIG. 2 is a back perspective view of the preferred embodiment of a folding chair backpack enveloping two folded chairs and a sun umbrella.
Figure 3:
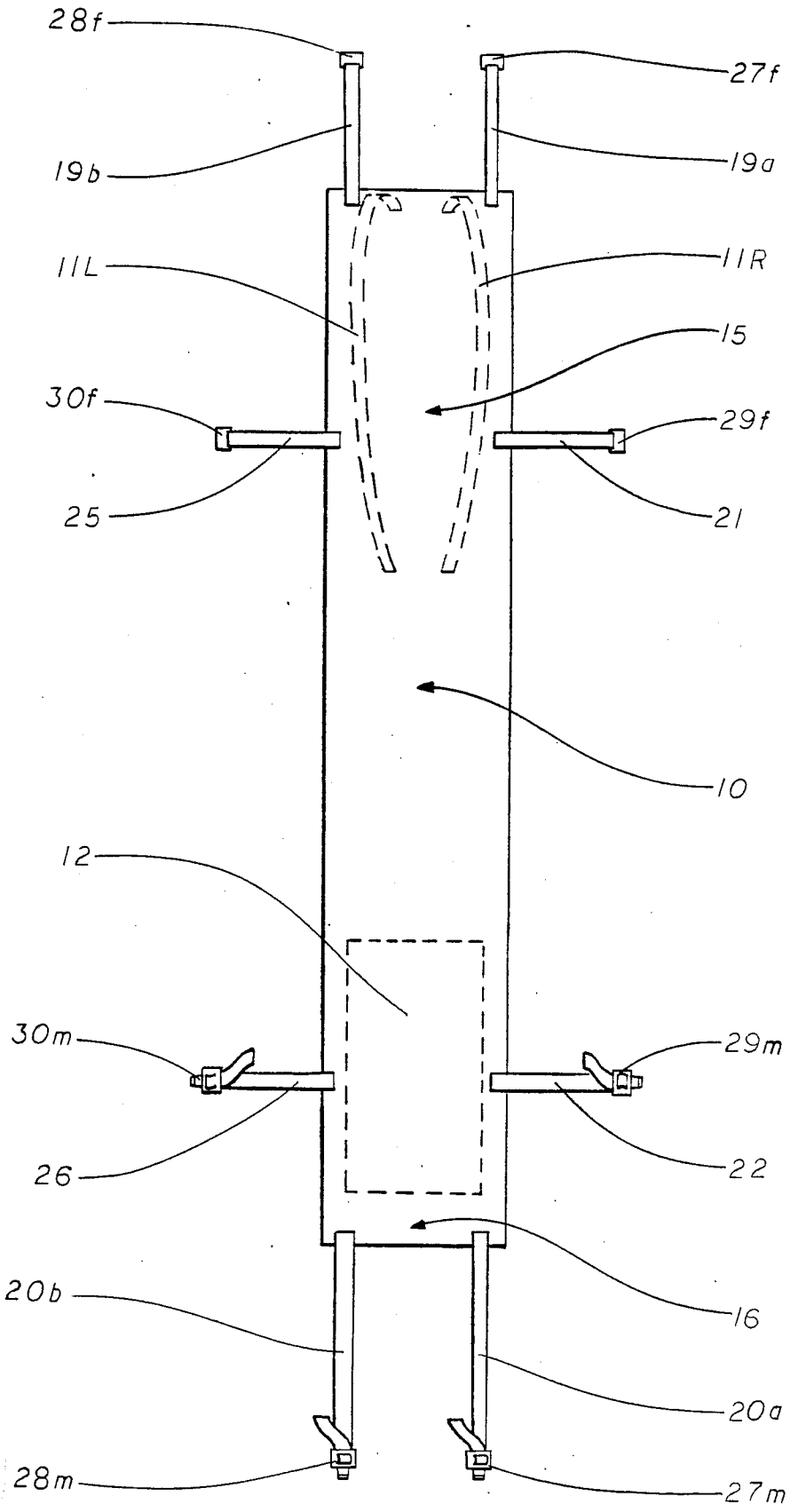
FIG. 3 is a plan view of the preferred embodiment of a folding chair backpack laid out flat.

FIG. 3 shows the preferred embodiment of the invention laid out flat as it might look laying on the floor. FIGS. 1 and 2 show two perspective views of the preferred embodiment of the invention enveloping two folding chairs and a sun umbrella. This enveloping structure is comprised of a front side 15, a back side 16, a top side, a bottom side 17, a right side and a left side. The main body 10, made of a rectangular sheet material such as cloth, comprises the bottom side 17 and most of the front side 15 and approximately half of the back side 16. It is necessary for this sheet material to comprise at least part of the front side 15 and/or part of the back side 16 to allow for necessary adjustments due to varying size loads and insure that the bottom side 17 is comprised entirely of this sheet material so that long slender objects can be supported by the bottom side 17. The main body 10 should also be of sufficient width to support these long slender objects without the bottom of the long slender objects slipping off to one side, thereby loosing the bottom support provided by the main body 10.

Figure 6:
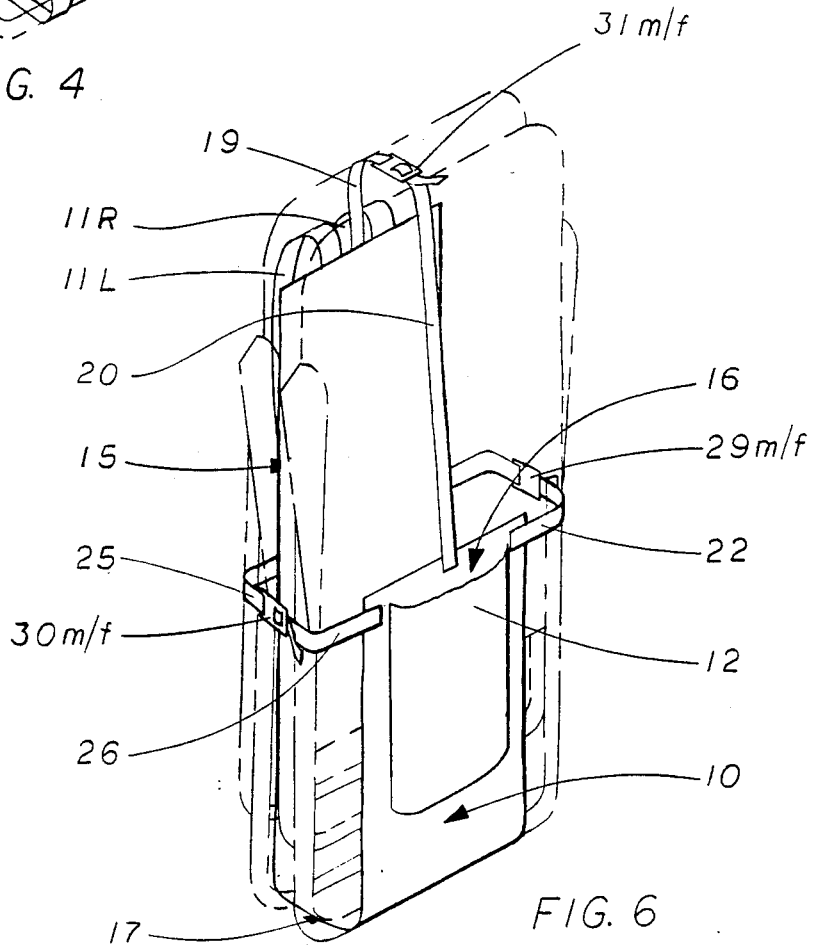
FIG. 6 is a back perspective view of the folding chair backpack with a single strap completing the vertical adjustable loop.
Figure 5:
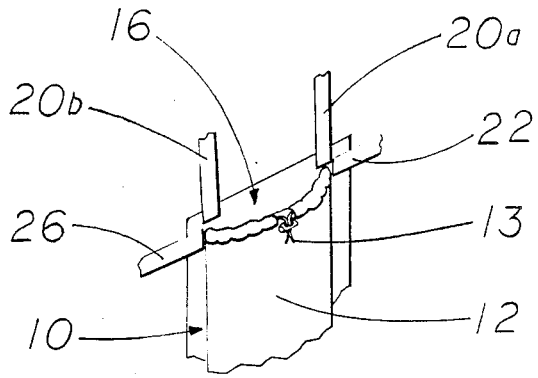
FIG. 5 is a fragmentary view of the drawstring closure of the top of the pocket.

If a pocket 12 is to be attached to the back side 16, then the sheet material comprising the main body 10, should comprise a substantial part of the back side 16, sufficient to attach the pocket 12. This pocket 12 should be constructed of flexible material such as cloth or nylon, so as to allow this pocket 12 to wrap around the right side, left side, and or bottom side 17. This maya be necessary to maintain a snug fitting enveloping structure should the dimensions of the chair(s) or other load be such that demands the dimension of the back side 16 to be smaller then the dimension of the packet. The bottom of the pocket 12 can be made of mesh material that allows sand, grit, and other small particles to pass through this mesh while preventing larger objects such as coins or keys from passing through. The top of pocket 12 may be partially or fully closed by a drawstring 13 as shown in FIG. 6. The ends of this drawstring 13 should be attached as close as possible to the attachment points of the right side-back strap 22 and left side-back strap 26 to the main body 10.

The remainder of the front side 15 is comprised of portions of the top-front straps 19*a* and 19*b* and portions of the rightside-front strap 21 and leftside-front strap 25. These straps 19*a*, 19*b*, 21, and 25 are all attached to the main body 10.

The remainder of the back side 16 is comprised of portions of the top-back straps 20*a* and 20*b* and portions of the rightside-back strap 22 and leftside-back strap 26. These straps 20*a*, 20*b*, 22, and 26 are all attached to the main body 10. The pocket 12 is attached to the back side 16, proximate the center.

The top portion of the enveloping structure is comprised of the mating ends of straps 19*a* and 20*a* and mating ends of straps 19*b* and 20*b*.

The right side of the enveloping structure is comprised of the mating ends of straps 21 and 22 and the left side of the enveloping structure is comprised of the mating ends of straps 25 and 26.

The mating ends of the straps are fastened together by adjustable fasteners. Although numerous designs for adjustable fasteners could be used, FIG. 3 shows the straps 19*a*, 19*b*, 21 and 25 fastened to the female halves of quick release buckles 27*f*, 28*f*, 29*f*, and 30*f* respectively and straps 20*a*, 20*b*, 22 and 26 looped through the male halves of quick release buckles 27*m*, 28*m*, 29*m*, and 30*m* respectively. The quick release feature allows for quick and easy assembly of the backpack around the chairs.

The two shoulder straps 11R and 11L are attached to the main body 10 proximate to the top-front straps 19*a* and 19*b* and the right/leftside-front straps 21 and 25. Buckles can allow for adjustment of the length of the shoulder straps 11R and 11L.

The distance between where straps 25 and 26 are attached to the main body 10 and the distance between where straps 21 and 22 are attached to the main body 10 should be approximately equal to the width (front to back) plus the height (top to bottom) of the average load expected to be carried by the device.

OPERATION OF THE PREFERRED EMBODIMENT OF THE INVENTION

To properly secure a folding chair, or a number of folding chairs, the invention should be laid out on a reasonably flat surface with the shoulder straps 11R,L on the underside of the main body 10 as in FIG. 3. The chair(s) should be placed over the main body 10 and over the shoulder straps 11R,L such that the ends of straps 19*a*, 19*b*, 21, and 25 protrude from under the chair(s). The straps 20*a* and 20*b* should then be brought up over the chair(s) and mated with straps 19*a* and 19*b* respectively. The loose ends of straps 20*a* and 20*b* protruding from the male half of the adjustable buckles 27*m* and 28*m* respectively should be pulled so as to tighten the enveloping structure circumferentially around the top side, back side 16, bottom side 17 and front side 15. The straps 22 and 26 should be fastened to straps 21 and 25 respectively. If long slender objects are desired to be transported, the straps 26 and 22 should be loose so that the long slender objects can be slipped in between the chair(s) and the front side 15 and in between the straps 19*a* and 19*b* or so that the long slender objects can be slipped in between the chair(s) and the back side 16 and in between straps 20*a* and 20*b*. The loose ends of straps 22 and 26 protruding from the male half of the adjustable buckles 29*m* and 30*m* respectively should be pulled so as to tighten the enveloping structure circumferentially around the front side 15, right side, back side 16, and left side.

The chair(s) and any long slender objects are now secure within the enveloping structure and can be hoisted onto one's back and carried on the shoulders by inserting one arm through each of the two shoulder straps 11R,L, in a fashion similar to putting on a backpack. Additional items may be carried in the pocket 12 as the enveloped folded chair(s) provide a frame that allows additional weight to be supported.

Figure 4:
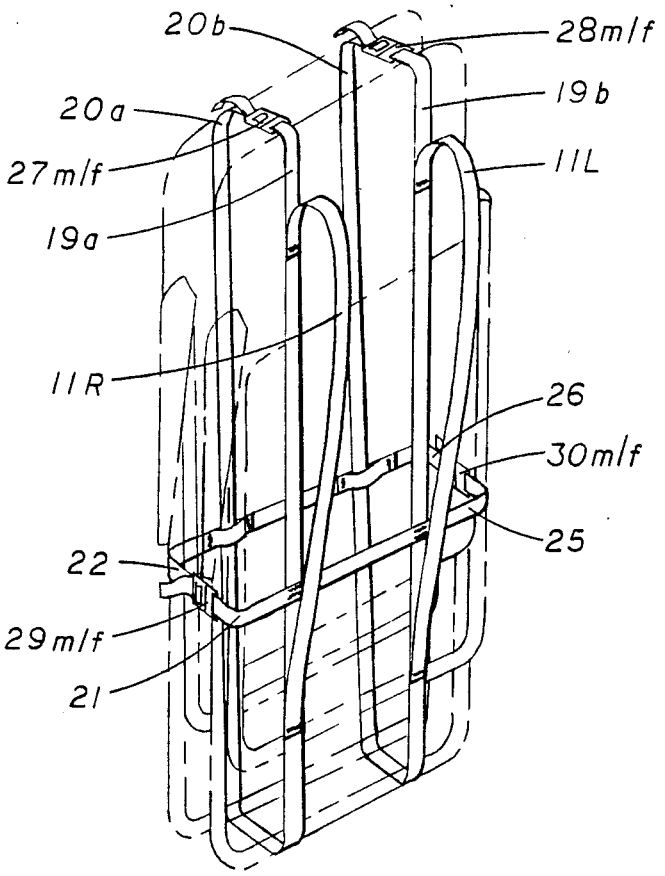
FIG. 4 is a front perspective view of an alternate embodiment of a folding chair backpack enveloping two folded chairs. This is an embodiment which would not be able to support long slender objects but would have the needed lateral stability for supporting folding chair(s).

There are numerous variations from the preferred embodiment in accomplishing the enveloping structure and adjustments necessary to accommodate a varying number of chairs or different sizes of chairs and long slender objects. They might use different number of straps or amount of cloth in comprising the enveloping structure or may not include a pocket. For example, FIG. 4 shows an alternate embodiment consisting of two vertical loops and a single horizontal loop made from only straps and buckles. For very tall objects, additional horizontal loops could easily be added and would be located parallel and above the horizontal loop shown and fastened to the vertical loops in a similar manner as the single horizontal loop shown in FIG. 4. Another alternate embodiment may replace the two pairs of vertical straps 19*a*, 20*a* and 19*a*, 20*b* in FIGS. 1 and 2 with a single vertical strap. This embodiment is shown in FIG. 6 with the single vertical strap being comprised of a top back strap 20 and a top front strap 19 and a single quick release buckle 31*m,f* connecting the two top straps 19 and 20. In this configuration the left side-back strap 26 and the right side-back strap 22 should be attached to the main body very near the corners where the top back straps 20*a* and 20*b* are shown attached in FIGS. 1 and 2 so as to support these corners of the main body 10. The single vertical strap can wrap around any long slender objects thus supporting the upper part of the long slender objects and preventing them from tipping to one side or the other. Accordingly, the scope of the invention should be determined by the claims and their legal equivalents.

The use of the invention should not be limited to carrying folding chairs. It can also carry other fairly rigid planar items such as body boards, large pictures, exercise pads, sheets of wood or plastic, or boxes with items inside. It could also carry a large bulky sack that had many loose objects packed inside.

I claim:

1. A folding chair backpack for transporting a varying number of folding chairs or other such rigid planar objects, henceforth referred to as a load, comprising:

an enveloping structure to surround, support and secure said load, said enveloping structure having a front side, back side, top side, bottom side, left side and right side and consisting of one or more horizontal loops and one or more vertical loops;

said enveloping structure being comprised of flexible material such as pliable straps and/or fabric, whereby insertion of said load into said enveloping structure lends rigidity and form to said enveloping structure, thereby defining said front side, said back side, said top side, said bottom side, said left side and said right side;

a pair of shoulder straps attached to said front side permitting said enveloping structure to be carried by a person upon their shoulders whereby freeing up their hands for other tasks;

said vertical loop having adjustable means that permit a varying circumferential dimension around said front side, said bottom side, said back side and said top side and said horizontal loop having adjustable means that permit a varying circumferential dimension around said front side, said left side, said back side and said right side;

said horizontal loop is attached with said vertical loop on both said front side and said back side such that when said chair backpack is enveloping said load, said horizontal loop is restricted from sliding or moving in a direction approximately perpendicular to said vertical loop whereby horizontal stability is achieved and said chair backpack firmly contains said load, especially when hoisting said folding chair backpack upon said person's shoulders.

2. A folding chair backpack as defined in claim 1 herein at least one said horizontal loop is connected or interlaced with at least one said vertical loop on said front side and said back side.

3. A folding chair backpack as defined in claim 2 wherein said bottom side and portions of said front side and/or said back side are comprised of sheet material such as cloth to permit the support of long slender objects such as poles by said bottom side.

4. A folding chair backpack as defined in claim 3 wherein said vertical adjustable means is comprised of a single adjustable strap.

5. A folding chair backpack as defined in claim 3 wherein said vertical adjustable means is comprised of two sets of adjustable straps attached to said sheet material proximate the top of said front side and said back side and comprises said top side and portions of said front side and said back side, and said horizontal adjustable means is comprised of adjustable straps attached to said sheet material proximate the middle of said back side and the middle of said front side and proximate to said left side and said right side, and comprises said left side and said right side and portions of said front side and said back side; said shoulder straps being attached to said sheet material proximate the top and middle of said front side.

6. A folding chair backpack as defined in claim 5 wherein said straps that comprise said vertical adjustable means and said horizontal adjustable means utilize a quick release type of buckle wherein said buckle can independently adjust the length of said straps and attach/detach from itself thereby making/breaking said horizontal loops or said vertical loops.

7. A folding chair backpack as defined in claim 5 wherein a pocket of flexible material is attached to said back side allowing said flexible pocket to wrap around said bottom side, said right side, or said left side if dimensions of load are such that dictates a dimension of said back side to be smaller than corresponding dimension of said flexible pocket.

8. A folding chair backpack as defined in claim 7 wherein the top end of said flexible pocket can be closed by a drawstring; said drawstring being comprised of rope or string material and captured by loops at said top end of said pocket and two of the ends of said drawstring being attached to said back side, and the attachment or interlacing of said horizontal adjustable means to said vertical adjustable means prevents any major distortions to said back side while said drawstring closes said top end of said flexible pocket.

9. A folding chair backpack as defined in claim 7 wherein said pocket of flexible material is comprised of a mesh bottom whereby permitting small items such as sand or loose dirt to fall through, thereby avoiding accumulation of said small items in the bottom of the pocket.

* * * * *